US007756458B2

(12) United States Patent
Viney et al.

(10) Patent No.: US 7,756,458 B2
(45) Date of Patent: Jul. 13, 2010

(54) FUSING MEMBER REJUVENATING METHOD AND SYSTEM IN A TONER IMAGE PRODUCING MACHINE

(75) Inventors: Jeffrey M. Viney, Rochester, NY (US); Douglas B Wilkins, Rochester, NY (US); Brian J. Mcnamee, Brockport, NY (US)

(73) Assignee: Xerox Corporation, Norwalk, CT (US)

( * ) Notice: Subject to any disclaimer, the term of this patent is extended or adjusted under 35 U.S.C. 154(b) by 808 days.

(21) Appl. No.: 11/609,684

(22) Filed: Dec. 12, 2006

(65) Prior Publication Data

US 2008/0138126 A1 Jun. 12, 2008

(51) Int. Cl.
*G03G 15/20* (2006.01)

(52) U.S. Cl. ..... 399/327

(58) Field of Classification Search ..... 399/327, 399/71

See application file for complete search history.

(56) References Cited

U.S. PATENT DOCUMENTS 4,078,929 A 3/1978 Gundlach 5,678,134 A * 10/1997 Miki et al. ..... 399/71

FOREIGN PATENT DOCUMENTS

JP 2006259588 A * 9/2006

* cited by examiner

*Primary Examiner*—Stephen D Meier
*Assistant Examiner*—Andrew V Do
(74) *Attorney, Agent, or Firm*—Ronald E. Prass, Jr.; Prass LLP

(57) ABSTRACT

A fusing member rejuvenating method and apparatus for cleaning and rejuvenating an external surface of a fusing member of a toner image producing machine. The fusing member rejuvenating method and apparatus include (a) a cleaning cartridge including a movable cleaning material movable at a first speed for contacting and removing residual toner and dirt from an external surface of the fusing member; (b) a first articulating device connected to the movable cleaning cartridge for selectively moving the movable cleaning cartridge into and out of contact with the external surface of the fusing member; (c) a scouring cartridge including a movable scouring material movable at a second speed for contacting and scouring the external surface of the fusing member; and (d) a second articulating device connected to the movable scouring cartridge for selectively moving the movable scouring cartridge into and out of contact with the external surface of the fusing member.

18 Claims, 4 Drawing Sheets

FUSING MEMBER REJUVENATING METHOD AND SYSTEM IN A TONER IMAGE PRODUCING MACHINE

The present disclosure relates generally to toner image producing machines, and more particularly, concerns a fusing member rejuvenating method and system for cleaning and rejuvenating an external surface of a fusing member in a toner image producing machine.

In a typical toner image producing machine, for example an electrostatographic printing process machine contained within a single enclosing frame, an imaging region of a toner image bearing member such as a photoconductive member is charged to a substantially uniform potential so as to sensitize the surface thereof. The charged portion of the photoconductive member is irradiated or exposed to a light image of an original document being reproduced. Exposure of the charged photoconductive member selectively dissipates the charges thereon in the irradiated areas. This records an electrostatic latent image on the photoconductive member corresponding to the informational areas contained within the original document.

After the electrostatic latent image is recorded on the photoconductive member, the latent image is developed by bringing a developer material into contact therewith. Generally, the developer material comprises toner particles adhering triboelectrically to carrier granules. The toner particles are attracted from the carrier granules to the latent image forming a toner powder image on the photoconductive member. The toner powder image is then transferred from the photoconductive member to a copy sheet. The toner particles are then heated by a fusing apparatus within the single enclosed frame to permanently affix the powder image to the copy sheet. Image release oils usually are applied to the heated surface of the fusing apparatus to help image release, but unfortunately end up releasing undesirable fusing volatiles into the single enclosed environment. Residual toner particles remaining on the photoconductive surface following image transfer as above are then removed by a cleaning apparatus in order to prepare the surface for forming another toner image.

The foregoing generally describes a typical black and white electrostatographic printing machine. With the advent of multicolor electrophotography, it is desirable to produce multicolor images using any one of a number of different processes such as image-next-to-image or image-on-image single pass or multiple pass processes as highlight color or full color processes.

A typical highlight color reproduction machine records successive electrostatic latent images on the photoconductive surface. One latent image is usually developed with black toner. The other latent image is developed with color highlighting toner, e.g. red toner. These developed toner powder images are transferred to a sheet to form a color-highlighted document. When combined, these developed images form an image corresponding to the entire original document being printed. Such color highlighting reproduction machine can be of the so-called single-pass variety, where the color separations are generated sequentially by separate imaging and toning stations, or of the so-called multiple-pass variety, where the separations are generated by a single imaging station in subsequent passes of the photoreceptor and are alternatively toned by appropriate toning stations. A particular variety of single-pass highlight color reproduction machines using tri-level printing have also been developed. Tri-level electro-statographic printing is described in greater detail in U.S. Pat. No. 4,078,929. As described in this patent, the latent image is developed with toner particles of first and second colors simultaneously. The toner particles of one of the colors are positively charged and the toner particles of the other color are negatively charged.

Another type of color reproduction machine which may produce highlight color copies initially charges the photoconductive member. Thereafter, the charged portion of the photoconductive member is discharged to form an electrostatic latent image thereon. The latent image is subsequently developed with black toner particles. The photoconductive member is then recharged and image wise exposed to record the highlight color portions of the latent image thereon. A highlight latent image is then developed with toner particles of a color other than black, e.g. red, and then developed to form the highlight latent image. Thereafter, both toner powder images are transferred to a sheet and subsequently fused thereto to form a highlight color document.

One example of a full color process machine having plural image forming stations utilizes an image-on-image (IOI) system in that the photoreceptive member is recharged, re-imaged and developed for each color separation. This charging, imaging, developing and recharging, re-imaging and developing, all followed by transfer to paper, is done in a single revolution of the photoreceptor in so-called single pass machines, while multi-pass architectures form each color separation with a single charge, image and develop, with separate transfer operations for each color. Again as above, the transferred image is fused on the copy sheet using a heated fusing apparatus, while residual toner particles remaining on the photoconductive surface following image transfer as above are then removed by a cleaning apparatus in order to prepare the surface for forming another toner image.

In conventional machines as above, it has been found that contamination accumulates within the fusing station apparatus, typically building up on the various fusing members or rolls used in fusing process. Conventionally, it is known to use a cleaning web in attempts to remove such contamination. Even with such a cleaning web, contamination has been known to still build up on fusing rolls and actually require roll replacements because of image quality defects created by such contamination.

This has also been found to be true of contamination on external heater rolls used to heat fuser rolls at a fusing station. As already pointed out, many times the contamination is more than an ordinary cleaning web can handle and the contamination ends up building up on the external heater rolls. Often, the only way to effectively clean such contamination is by hand. As such, a service technician usually must be called, and must go in and clean these rolls by hand and while they are still hot. They typically must be cleaned as such at a temperature of about 440° F. because they will not clean well after they are allowed to cool below that. Such cleaning therefore is very risky. Even with such cleaning, the effective life of the rolls is relatively limited before poor image quality forces roll replacement.

There is therefore a need for relatively less risky and more effective methods and apparatus for cleaning as well as rejuvenating fusing members such as external heater rolls in order increase image quality and roll life.

Thus in accordance with the present disclosure, there has been provided a fusing member rejuvenating method and apparatus for cleaning and rejuvenating an external surface of a fusing member of a toner image producing machine. The fusing member rejuvenating method and apparatus include (a) a cleaning cartridge including a movable cleaning material movable at a first speed for contacting and removing residual toner and dirt from an external surface of the fusing member; (b) a first articulating device connected to the movable cleaning cartridge for selectively moving the movable cleaning cartridge into and out of contact with the external surface of the fusing member; (c) a scouring cartridge including a movable scouring material movable at a second speed for contacting and scouring the external surface of the fusing member; and (d) a second articulating device connected to the movable scouring cartridge for selectively moving the movable scouring cartridge into and out of contact with the external surface of the fusing member.

The foregoing and other features of the instant disclosure will be apparent and easily understood from a further reading of the specification, claims and by reference to the accompanying drawing in that:

Figure 1:
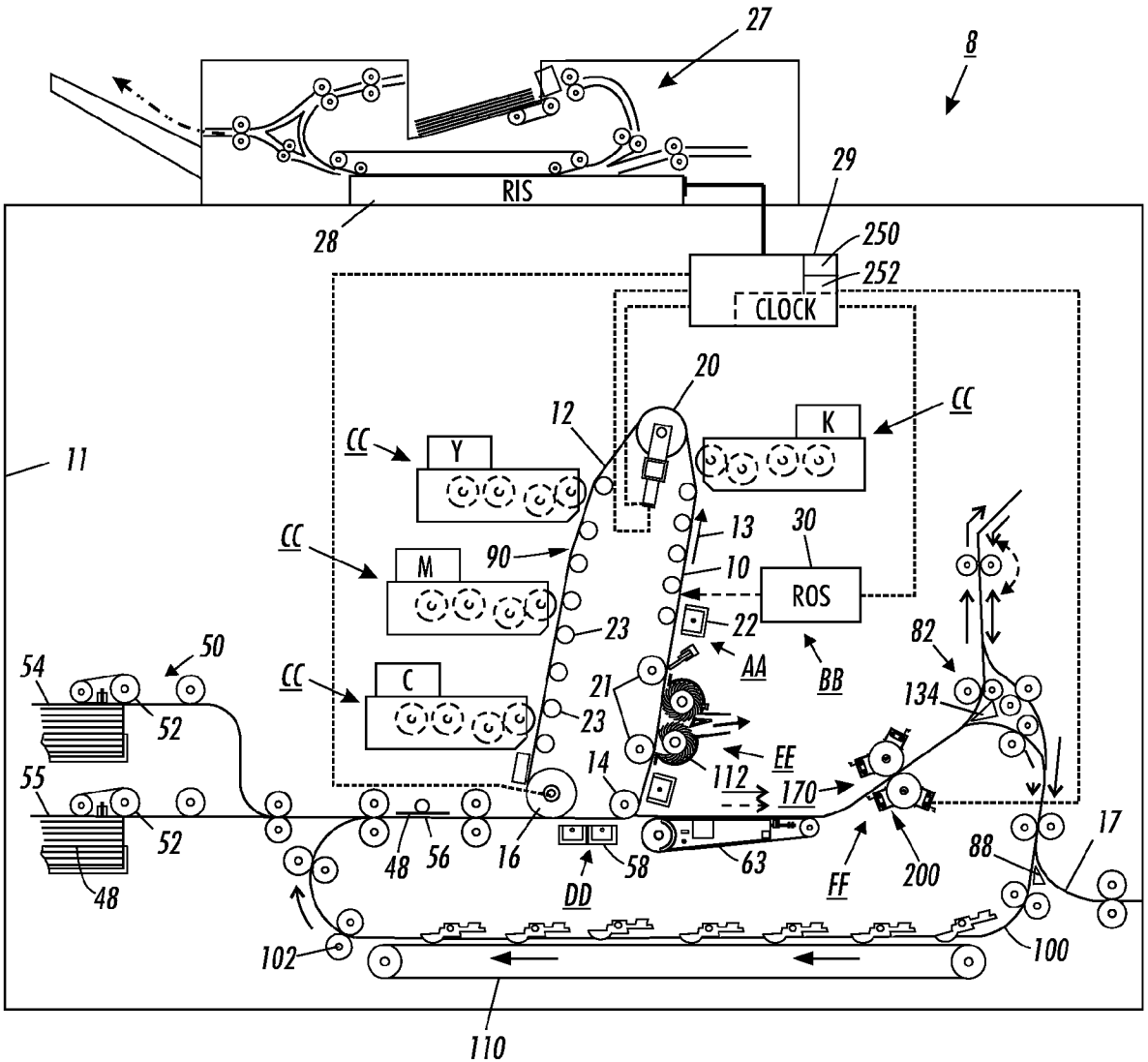
FIG. 1 is a schematic elevational view of an electrostatographic reproduction machine having a fusing station including the fusing member rejuvenating method and system of the present disclosure.

Referring first to FIG. 1, it schematically illustrates an electrostatographic reproduction machine 8 that generally employs a photoconductive belt 10 mounted on a belt support module. Preferably, the photoconductive belt 10 is made from a photoconductive material coated on a conductive grounding layer. Belt 10 moves in the direction of arrow 13 to advance successive portions sequentially through various processing stations disposed about the path of movement thereof. Belt 10 is entrained as a closed loop 90 about stripping roll 14, drive roll 16, idler roll 21, and backer rolls 23.

Initially, a portion of the photoconductive belt surface passes through charging station AA. At charging station AA, a corona-generating device indicated generally by the reference numeral 22 charges the photoconductive belt 10 to a relatively high, substantially uniform potential.

As also shown the reproduction machine 8 includes a controller or electronic control subsystem (ESS) 29 that is preferably a self-contained, dedicated minicomputer having a central processor unit (CPU), electronic storage, and a display or user interface (UI). The ESS 29, with the help of sensors and connections, can read, capture, prepare and process image data and machine status information.

Still referring to FIG. 1, at an exposure station BB, the controller or electronic subsystem (ESS) 29, receives the image signals from RIS 28 representing the desired output image and processes these signals to convert them to a continuous tone or gray scale rendition of the image that is transmitted to a modulated output generator, for example the raster output scanner (ROS), indicated generally by reference numeral 30. The image signals transmitted to ESS 29 may originate from RIS 28 as described above or from a computer, thereby enabling the electrostatographic reproduction machine 8 to serve as a remotely located printer for one or more computers. Alternatively, the printer may serve as a dedicated printer for a high-speed computer. The signals from ESS 29, corresponding to the continuous tone image desired to be reproduced by the reproduction machine, are transmitted to ROS 30.

ROS 30 includes a laser with rotating polygon mirror blocks. At exposure station BB, the ROS 30 illuminates the charged portion on the surface of photoconductive belt 10. The ROS will expose the photoconductive belt 10 to record an electrostatic latent image thereon corresponding to the continuous tone image received from ESS 29. As an alternative, ROS 30 may employ a linear array of light emitting diodes (LEDs) arranged to illuminate the charged portion of photoconductive belt 10 on a raster-by-raster basis.

After the electrostatic latent image has been recorded on photoconductive surface 12, belt 10 advances the latent image through development stations CC containing the first color toner. Successive imaging stations and developer units containing other color toners, in the form of dry particles. At each developer unit the toner particles are appropriately attracted electrostatically to the latent image using commonly known techniques.

With continued reference to FIG. 1, after the electrostatic latent image is developed, the toner powder image present on belt 10 advances to transfer station DD. A print sheet 48 is advanced to the transfer station DD, by a sheet feeding apparatus 50. Sheet-feeding apparatus 50 may include a corrugated vacuum feeder (TCVF) assembly 52 for contacting the uppermost sheet of stack 54, 55. TCVF 52 acquires each top sheet 48 and advances it to vertical transport 56. Horizontal transport 56 directs the advancing sheet 48 through feed rolls into image transfer station DD to receive an image from photoreceptor belt 10 in a timed manner. Transfer station DD typically includes a corona-generating device 58 that sprays ions onto the backside of sheet 48. This assists in attracting the toner powder image from photoconductive surface 12 to sheet 48. After transfer, sheet 48 continues to move and is picked up by a pre-fuser transport assembly 63 and forwarded to fusing station FF.

Figure 2:
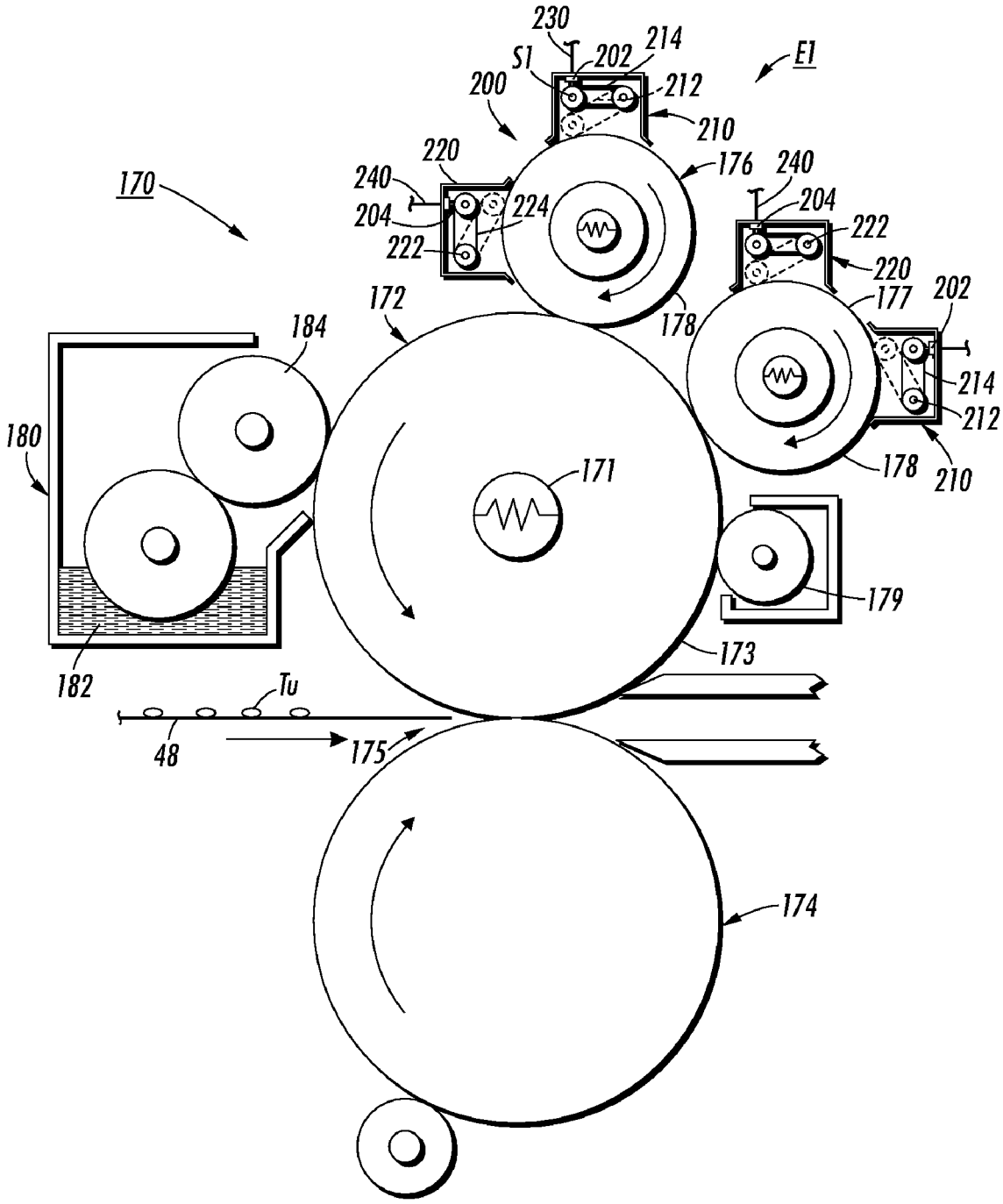
FIG. 2 is an enlarged illustration of the fusing station of FIG. 1 showing a first embodiment of the fusing member rejuvenating method and system of the present disclosure.
Figure 3:
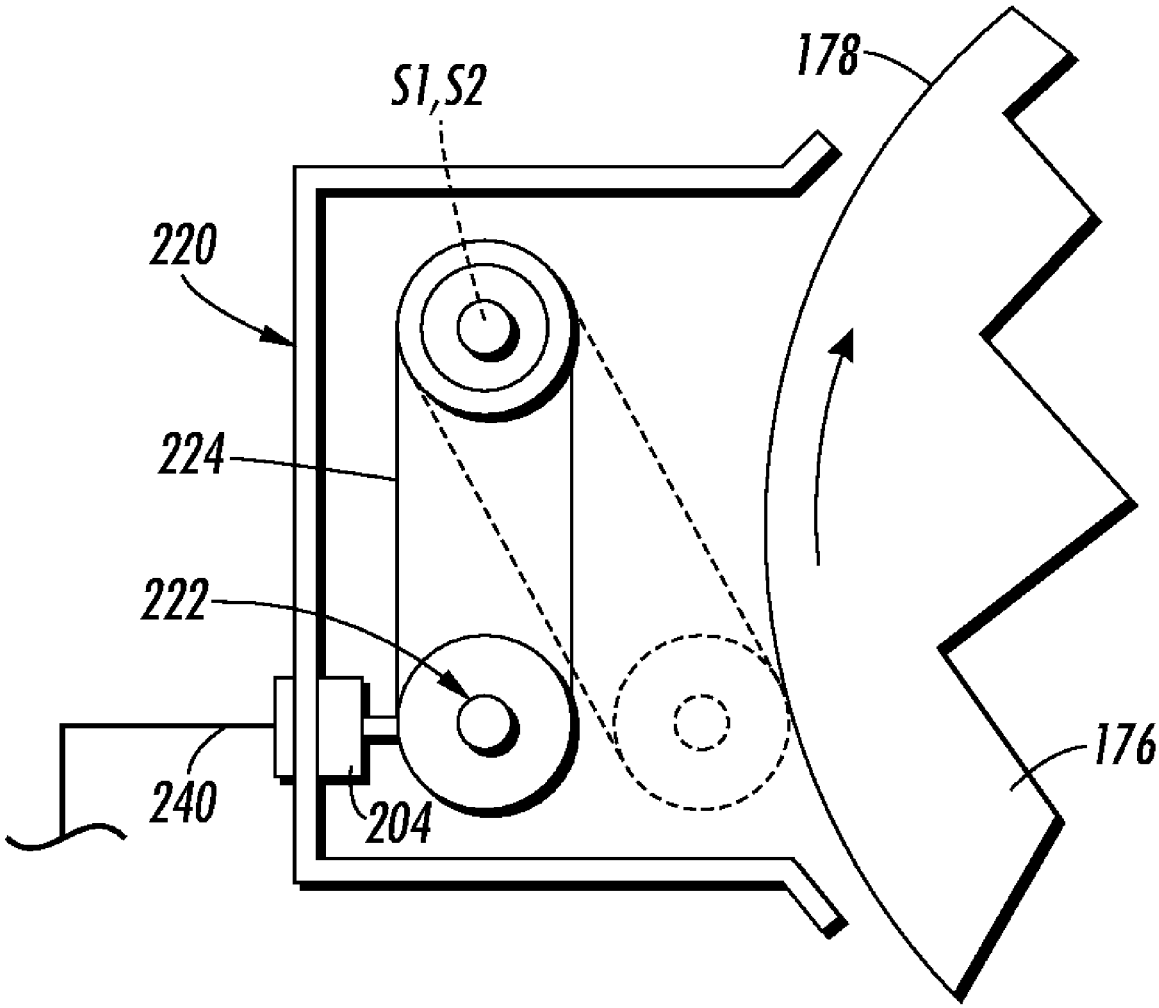
FIG. 3 is an enlarged illustration of a portion of the fusing station of FIG. 2 showing an articulating scouring cartridge of the fusing member rejuvenating method and system of the present disclosure.

Referring now to FIGS. 1-2, fusing station FF includes the fusing apparatus of the present disclosure (indicated generally by the reference numeral 170) for fusing and permanently affixing the transferred toner powder image Tu to the copy sheet 48. As shown, in one embodiment, the fusing apparatus 170 includes the fusing member rejuvenating method and system 200 of the present disclosure (to be described in detail below) being used for cleaning and rejuvenating the external surface 178 of the at least one external heater roll 176, 177. In other embodiments, the fusing member rejuvenating method and system 200 of the present disclosure could be used for cleaning and rejuvenating other fusing members, for example, for cleaning and rejuvenating the fuser roll 172 or pressure roll 174, given appropriate selection of the cleaning and scouring materials therein as will be described below.

Referring still to FIG. 1, sheet 48 then passes to a gate 88 that either allows the sheet to move directly via output 17 to a finisher or stacker, or deflects the sheet into the duplex path 100. Specifically, the sheet (when to be directed into the duplex path 100), is first passed through a gate 134 into a single sheet inverter 82. That is, if the second sheet is either a simplex sheet, or a completed duplexed sheet having both side one and side two images formed thereon, the sheet will be conveyed via gate 88 directly to output 17. However, if the sheet is being duplexed and is then only printed with a side one image, the gate 88 will be positioned to deflect that sheet into the inverter 82 and into the duplex loop path 100, where that sheet will be inverted and then fed to acceleration nip 102 and belt transports 110, for recirculation back through transfer station DD and fuser 170 for receiving and permanently fixing the side two image to the backside of that duplex sheet, before it exits via exit path 17.

After sheets separate from photoconductive surface 12 of belt 10, residual toner/developer and paper fiber particles remaining adhered to photoconductive surface 12 are removed from surface 12 by a cleaning apparatus 112 at cleaning station EE.

Referring again to FIGS. 1-2, fusing apparatus 170 includes a heated fuser roller 172 having a surface 173, and a pressure roller 174 that form a fusing nip 175 through which the sheet 48 is passed with the powder image Tu on the copy sheet 48 contacting fuser roller 172. The pressure roller 174 is loaded against the fuser roller 172 forming the fusing nip 175 for providing the necessary pressure to fix the heated toner powder image Tu to the copy sheet 48. The fuser roll 172 for example is internally heated by a quartz lamp 171 and externally by at least an external heater roll 176, 177 as shown in order to more precisely maintain the temperature of its surface 173 within a desired fusing range. While the rejuvenating method and system 200 is being used to clean and maintain the external heater rolls 176, 177, the fuser roll surface 173 may be cleaned by a cleaning device such as a cleaning roll 179. The fuser roll surface 173 may also be lubricated by a release agent device 180 including in a reservoir 182 and at least a donor roll 184 for applying the release agent to the surface of the fuser roll.

The apparatus of the fusing member rejuvenating method and system 200 of the present disclosure as shown includes (a) a cleaning cartridge 210 having a movable cleaning device 212 movable at a first speed S1 and having a cleaning material 214 for contacting and removing residual toner and dirt from the external surface 178 of the fusing member, such as the external heater rolls 176, 177; (b) a first articulating device 202 connected to the movable cleaning device 212 and at 230 to the controller 29, for selectively moving the movable cleaning device 212 into and out of contact with the external surface 178 of the fusing member; (c) a scouring cartridge 220 including a movable scouring device 222 movable at said first speed S1, and at a second speed S2 and having a scouring material 224 for contacting and scouring the external surface 178 of the fusing member, such as the external heater rolls 176,177; and (d) a second articulating device 204 connected to the movable scouring device 222 and at 240 to the controller 29, for selectively moving the movable scouring device 222 into and out of contact with the external surface 178 of the fusing member.

Figure 4:
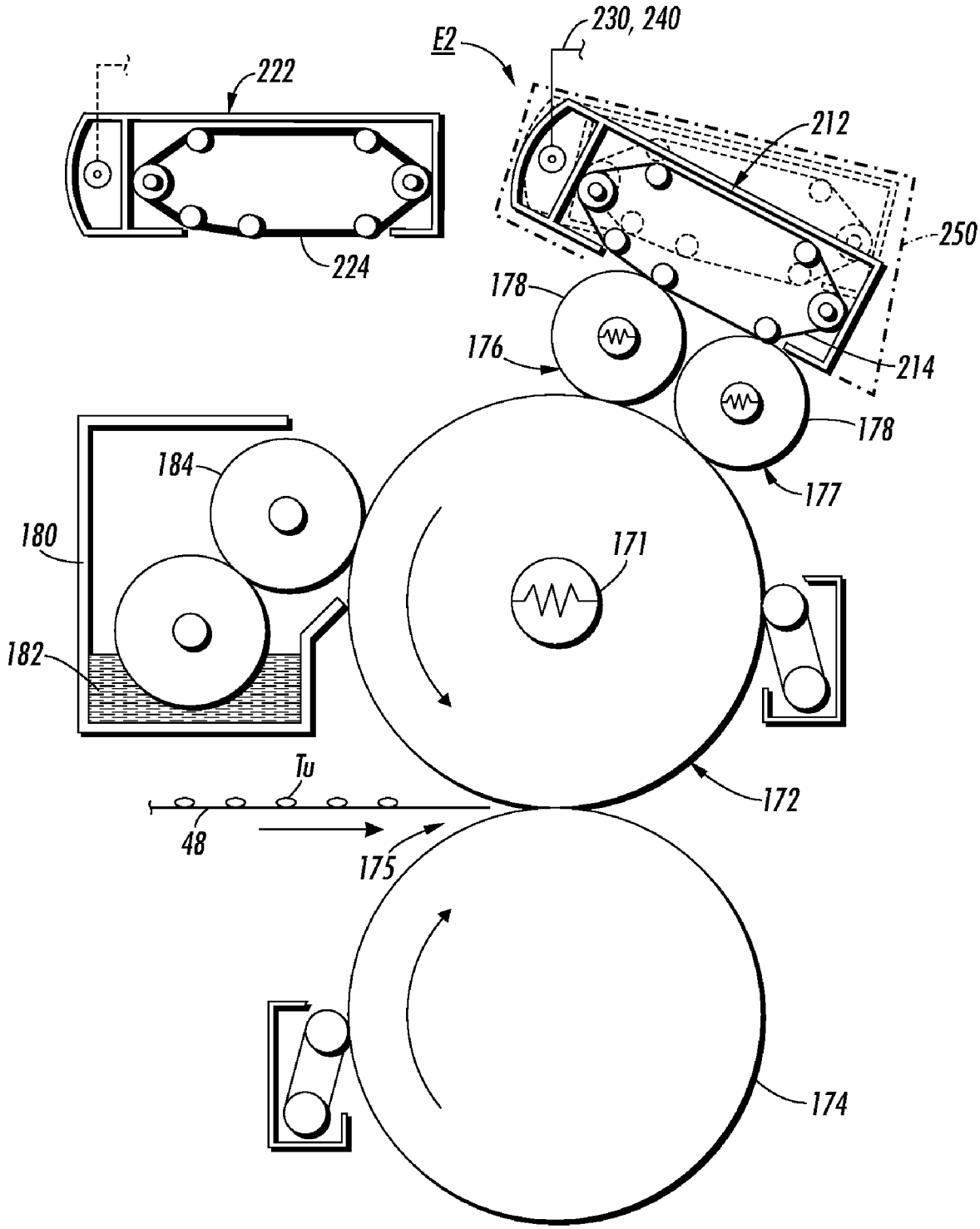
FIG. 4 is an enlarged illustration of the fusing station of FIG. 1 showing a second embodiment of the fusing member rejuvenating method and system of the present disclosure.

A first embodiment E1 of the cleaning cartridge 210 can, for example, be permanently mounted within the fusing station EE as illustrated in FIG. 2, or it may be an installable and removable embodiment E2 as illustrated in FIG. 4, to be periodically installed into the fusing station, run and then removed therefrom as intended. The cleaning material 214 in the disclosed cleaning cartridge 210 is for example a non-woven rough abrasive fabric such as that sold under the trade name SCOTCH-BRITE by the 3M Company of St. Paul Minn. SCOTCH-BRITE type materials could be used alone for cleaning the external heater rolls 176, 177, however, due to their relatively low melting temperatures these particular materials would need to be used at a temperature that is lower than a normal fusing temperature. It is however more advantageous to carry out such cleaning at the normal fusing temperature or at a temperature that is higher than the normal fusing temperature in order to effectively soften the contamination thereby increasing the ability the cleaning or scouring materials to remove it from the roll.

The scouring cartridge 220 includes a scouring material 224 consisting for example of singed heat resistant nylon fibers such as those sold under the trade name NOMEX by the DuPont Corporation of Wilmington Del. The scouring device 222 is movable at a second speed S2 that is significantly greater than the first speed S1 of the cleaning device 212. Singed NOMEX was tested and shown to scour and clean the external heater rolls 176, 177 very well, and as such can be used as an aggressive medium for such scouring and cleaning at a normal fuser operating temperature. It is believed that the singeing process for the NOMEX material creates a much more aggressive surface on the NOMEX material as well as effectively increases the thickness of web of it used in this application. According to an aspect of the present disclosure, in both types of materials (SCOTCH-BRITE, NOMEX), a cleaning additive could be added to each material 214, 224 in order to increase the ability of the material to clean the rolls 176, 177.

As illustrated, in the second embodiment E2 of FIG. 4, the cleaning cartridge 210, and the scouring cartridge 220, are each removably installable into a drive and control module 250 therefore in the fusing apparatus 170 (much like a tape cleaning head cassette into a video cassette player). As such, each cartridge 210, 220 can be selectively and periodically installed into its drive and control module 250 in the fusing apparatus 170 for operation in accordance with the method of the present disclosure to clean and rejuvenate the external heater rolls 176, 177.

As further illustrated in FIGS. 1-4, the fusing member rejuvenating method and system 200 of the present disclosure includes control means 250, (having a software routine 252), that is connected to the controller or ESS 29 of the machine 8 for operating the cleaning and scouring cartridges 210, 220 in accordance with the method of the present disclosure. The software routine 252 for example is an important part of the system 200. In accordance with the present disclosure, when cleaning and rejuvenation of the external heater rolls 176, 177 are desired, all the customer needs to do is run the software routine 252 (which runs all the motors for spinning the rolls, and sequentially cams the cleaning and scouring cartridges 210, 220 in accordance with the method of the disclosed system to be described below). Additionally, the software routine 252 will ensure that the external heater rolls 176, 177 are heated to the desired first and second temperatures and for the desired period of time, thus allowing the cartridges 210, 220 to do their jobs perfectly. Advantageously, the system of the present disclosure allows for such cleaning and rejuvenating of the external rolls to take place without the customers or service technician risking burning their hands. It also allows the customer to carryout such cleaning and rejuvenating whenever they want or whenever they see contamination starting to build up without waiting for or incurring the cost of a service call.

The software routine 252 could for example perform the following tasks in sequence for cleaning and scouring the external heater rolls 176, 177: (a1) raise the first temperature (if necessary) of the external heater rolls 176, 177 to a normal fusing temperature in order to prepare for scouring with the scouring device 222 using a scouring material such as singed NOMEX or (a2) lower the temperature (if necessary) of the external heater rolls 176, 177 to a fourth temperature T4 that is lower than the normal fusing temperature T2 for cleaning with the cleaning device 212 using a cleaning material such as SCOTCH-BRITE; (b) turn the main drive motor (not shown) on to run all the rolls of the fusing apparatus 170; (c) selectively cam the donor/external cam of the cartridges 210, 220 to a 225 degree position; (d) change the step rate or speed for the singed NOMEX web 224 from 360 to 720 in order to allow the web to more efficiently scour and remove the contamination from the external roll surface; (e) turn the SCOTCH-BRITE web on for about 3 minutes; and (f) reverse the sequence by turning off the and resetting all the system components.

Accordingly, the method of the present disclosure for rejuvenating a fusing member such as the external heater rollers 176, 177 of the fusing apparatus 170, includes (a) first heating the fusing member 176, 177 to a first temperature during a first period; (b) first contacting the fusing member at the first temperature with a cleaning cartridge 210 having a cleaning material 214 moving at a first speed S1 for removing residual toner and dirt from an external surface 178 of the fusing member 176, 177; (c) first retracting the cleaning cartridge 210 from contact with the external surface of the fusing member; (d) next heating the fusing member to a second temperature, greater than the first temperature, during a second period; (e) next contacting the fusing member at the second temperature with a scouring cartridge 220 having a scouring material 224 moving at a second speed S2 for scouring and rejuvenating the external surface of the fusing member; (f) next retracting the scouring cartridge 220 from contact with the external surface of the fusing member; (g) returning the temperature of the fusing member to the first temperature for a third period; and (g) re-contacting the fusing member at the first temperature with the cleaning material of the cartridge moving at the first speed S1 for removing residual toner and dirt from the external surface of the fusing member.

The method may also include adding a cleaning additive to the cleaning material 214, and/or the scouring material 224 in order to assist the removal of contamination from the surface 178 of the fusing member or external heater rolls 176, 177. In one case, the next contacting step more specifically comprises contacting the external surface 178 of the fusing member or external roll 176, 177 with a cleaning cartridge 210 having a non-woven abrasive fabric cleaning material 214 such as SCOTCH-BRITE. In another case, the next contacting step more specifically comprises contacting the external surface 178 of the fusing member or external roll 176, 177 with a scouring cartridge 220 having a singed heat resistant nylon fibers scouring material 224 such as NOMEX. Furthermore, the next contacting step more specifically comprises contacting the external surface 178 with the scouring material 224 moving at the second speed S2 which is significantly greater than the first speed S1 of the cleaning material 214. In addition, the next heating step more specifically comprises heating and raising the temperature of the fusing member or external heater roll 176, 177 to the second temperature during a second period of about 3 minutes.

As can be seen, there has been provided a fusing member rejuvenating method and apparatus for cleaning and rejuvenating an external surface of a fusing member of a toner image producing machine. The fusing member rejuvenating method and apparatus include (a) a cleaning cartridge including a movable cleaning material movable at a first speed for contacting and removing residual toner and dirt from an external surface of the fusing member; (b) a first articulating device connected to the movable cleaning cartridge for selectively moving the movable cleaning cartridge into and out of contact with the external surface of the fusing member; (c) a scouring cartridge including a movable scouring material movable at a second speed for contacting and scouring the external surface of the fusing member; and (d) a second articulating device connected to the movable scouring cartridge for selectively moving the movable scouring cartridge into and out of contact with the external surface of the fusing member.

It will be appreciated that various of the above-disclosed and other features and functions of this embodiment, or alternatives thereof, may be desirably combined into other different systems or applications. Therefore, unless specifically defined in a specific claim itself, steps or components of the disclosure should not be implied or imported from any above example as limitations to any particular order, number, position, size, shape, angle, color, or material. Additionally, it be appreciated that various presently unforeseen or unanticipated alternatives, modifications, variations or improvements therein may be subsequently made by those skilled in the art which are also intended to be encompassed by the following claims:

What is claimed is:

1. A method of rejuvenating a fusing member comprising:

(a) first heating the fusing member to a first temperature during a first period;

(b) first contacting the fusing member at said first temperature with a cleaning cartridge having a cleaning material moving at a first speed for removing residual toner and dirt from an external surface of the fusing member;

(c) first retracting said cleaning cartridge from contact with said external surface of said fusing member;

(d) next heating the fusing member to a second temperature, greater than said first temperature, during a second period;

(e) next contacting the fusing member at said second temperature with a scouring cartridge having a scouring material for scouring and rejuvenating said external surface of the fusing member;

(f) next retracting said scouring cartridge from contact with said external surface of said fusing member;

(g) returning the temperature of the fusing member to said first temperature for a third period; and (h) re-contacting the fusing member at said first temperature with said cleaning material moving at said first speed for removing residual toner and dirt from said external surface of the fusing member.

2. The method of claim 1, including adding a cleaning additive to said scouring material of said scouring cartridge.

3. The method of claim 1, wherein said first contacting step comprises contacting said external surface of said fusing member with a cleaning cartridge having a non-woven abrasive fabric as the cleaning material.

4. The method of claim 1, wherein said next contacting step comprises contacting said external surface of said fusing member with a scouring cartridge having a scouring material consisting of singed heat resistant nylon fibers.

5. The method of claim 1, wherein said next contacting step comprises contacting said external surface of said fusing member with the scouring material of the scouring cartridge moving at the second speed that is significantly greater than said first speed of said cleaning material.

6. The method of claim 1, wherein said next heating step comprises heating the fusing member to said second temperature during a second period of about 3 minutes.

7. A fusing member rejuvenating system for cleaning and rejuvenating an external surface of a fusing member of a toner image producing machine, the fusing member rejuvenating system comprising:

(a) a cleaning cartridge including a movable cleaning material movable at a first speed for contacting and removing residual toner and dirt from an external surface of the fusing member;

(b) first articulating means connected to said movable cleaning cartridge for selectively moving said movable cleaning cartridge into and out of contact with the external surface of the fusing member;

(c) a scouring cartridge including a movable scouring material movable at a second speed for contacting and scouring the external surface of the fusing member; and (d) second articulating means connected to said movable scouring cartridge for selectively moving said movable scouring cartridge into and out of contact with the external surface of the fusing member.

8. The rejuvenating system of claim 7, wherein said cleaning material comprises a non-woven abrasive fabric.

9. The rejuvenating system of claim 7, wherein said scouring material is comprised of singed heat resistant nylon fibers.

10. The rejuvenating system of claim 7, wherein said second speed of said scouring material is significantly greater than said first speed of said cleaning material.

11. A fusing apparatus including a fusing member rejuvenating system, the fusing apparatus comprising:

(a) a rotatable fuser roll having a first sheet contacting surface;

(b) a rotatable pressure roll having a second sheet contacting surface forming a fusing nip against said first sheet contacting surface of said fuser roll;

(c) at least one external heater roll including a heating element and contacting said first sheet contacting surface of said fuser roll for heating said first sheet contacting surface to a first temperature during a first period; and (d) a rejuvenating system for cleaning and rejuvenating an external surface of said at least one external heater roll, said rejuvenating system including:

(i) a cleaning cartridge including a movable cleaning material movable at a first speed for contacting and removing residual toner and dirt from an external surface of said at least one external heater roll;

(ii) first articulating means connected to said movable cleaning cartridge for selectively moving said movable cleaning cartridge into and out of contact with the external surface of said at least one external heater roll;

(iii) a scouring cartridge including a movable scouring material movable at a second speed for contacting and scouring the external surface of said at least one external heater roll; and (iv) second articulating means connected to said movable scouring cartridge for selectively moving said movable scouring cartridge into and out of contact with the external surface of said at least one external heater roll.

12. The fusing apparatus of claim 11, wherein said cleaning material comprises a non-woven abrasive fabric.

13. The fusing apparatus of claim 11, wherein said scouring material is comprised of singed heat resistant nylon fibers.

14. The fusing apparatus of claim 11, wherein said second speed of said scouring material is significantly greater than said first speed of said cleaning material.

15. The fusing apparatus of claim 11, wherein said heating element and external heater roll can heat said fusing member during a second period to a second temperature higher than said first temperature.

16. A toner image producing machine comprising:

(a) a moveable imaging member including an imaging surface;

(b) latent imaging means for forming a latent electrostatic toner image on said imaging surface of said moveable imaging member;

(c) a development apparatus mounted adjacent a path of movement of said moveable imaging member, said development apparatus toner for developing said latent electrostatic image on said imaging surface into a toner image;

(d) a transfer station for transferring said toner image from said imaging surface onto a copy sheet;

(e) a fusing apparatus for fusing said toner image onto said copy sheet, said fusing apparatus including a fuser roll, a pressure roll and at least one external heater roll for heating said fuser roll; and (f) a rejuvenating system for cleaning and rejuvenating an external surface of said at least one external heater roll, said rejuvenating system including:

(i) a cleaning cartridge including a movable cleaning material movable at a first speed for contacting and removing residual toner and dirt from an external surface of said at least one external heater roll;

(ii) first articulating means connected to said movable cleaning cartridge for selectively moving said movable cleaning cartridge into and out of contact with the external surface of said at least one external heater roll;

(iii) a scouring cartridge including a movable scouring material movable at a second speed for contacting and scouring the external surface of said at least one external heater roll; and (iv) second articulating means connected to said movable scouring cartridge for selectively moving said movable scouring cartridge into and out of contact with the external surface of said at least one external heater roll.

17. The toner image producing machine of claim 16, wherein said cleaning material comprises a non-woven abrasive fabric.

18. The toner image producing machine of claim 16, wherein said scouring material is comprised of singed heat resistant nylon fibers.

* * * * *